US005613680A

United States Patent [19]

Groves et al.

[11] Patent Number: 5,613,680

[45] Date of Patent: Mar. 25, 1997

[54] GAME CARD AND SYSTEM OF AUTHORIZING GAME CARD

[75] Inventors: David H. Groves, Adjala; Martin F. Hemy, Palgrave; John R. Spence, Newmarket; Virna A. Uliana, Hornby, all of Canada

[73] Assignee: International Verifact Inc., Etobicoke, Canada

[21] Appl. No.: 488,736

[22] Filed: Jun. 8, 1995

[51] Int. Cl.[6] ..... A63F 3/06

[52] U.S. Cl. ..... 273/138.2; 273/269; 463/19; 463/17; 463/25; 463/29

[58] Field of Search ..... 273/138 A, 139, 273/269, 138.2; 379/96, 97, 91, 92, 95; 364/412; 235/383; 463/19, 17, 25, 29

[56] References Cited

U.S. PATENT DOCUMENTS 4,937,853 6/1990 Brule et al. ..... 379/96

5,256,863 10/1993 Ferguson et al. ..... 235/383

5,327,485 7/1994 Leaden ..... 379/95

5,417,424 5/1995 Snowden et al. ..... 273/138 A

*Primary Examiner*—Benjamin H. Layno

[57] ABSTRACT

The present invention is directed to game cards and systems for tracking game cards. A computer tracking system is used which includes game or lottery type cards which must be activated to be eligible for a particular game or event. The activation step includes reading of a unique serial number or other identification code uniquely identifying the card. With this system, surplus game cards can be disposed of when they have not been activated. This simplifies tracking of sales of game cards and simplifies the distribution of funds to various parties in the sale and distribution chain.

13 Claims, 4 Drawing Sheets

GAME CARD AND SYSTEM OF AUTHORIZING GAME CARD

FIELD OF THE INVENTION

The present invention relates to game cards and the like type of cards which are sold and allow the purchaser to use the cards for a particular event or game. The present invention is also directed to an automated system for authorizing and tracking game cards.

BACKGROUND OF THE INVENTION

At the present time, there are a number of game cards or lottery type cards which allow a purchaser to use the card for a particular game or event. Most of these systems have a host of distributors who are provided with a supply of game cards and who sell the game cards and return any game cards which are not sold. These distributors then pay according to the number of game cards actually sold. Unfortunately, there is often a dispute with respect to the number of game cards sold due to destruction or disagreement with respect to the number of returned cards and potential problems result. Also, theft of game cards is a problem. In addition, a new supply of game cards for the next event must be forwarded to each distributor. Therefore, the system requires providing the distributors with supplies of game cards and requires the distributors to return any unsold game cards. This process is repeated for each game or event. This system requires substantial tracking and the manual exchange of game cards, and the system is awkward and inefficient.

It is important to be able to provide game cards, as the provided game cards can include their own printing or various features to avoid the fraudulent reproduction thereof. Therefore, it is desirable to provide game cards to the distributors. One of the major difficulties with the system is the physical return of the cards and the financial accounting based on the number of cards supplied minus the number of cards returned.

The present invention seeks to overcome the above difficulties and proposes a system which is an improvement over the prior art practices. In addition, the present invention discloses a game card having enhanced features.

SUMMARY OF THE INVENTION

A game card, according to the present invention, for playing a game of chance comprises game indicia on a face of the card and a machine scannable identifier code uniquely identifying the card.

According to a preferred embodiment of the invention, the game card includes a retail bar code for tracking of sales of the game cards.

According to yet a further aspect of the invention, the machine scannable code of the game card is an appropriately coded magnetic stripe provided on the game card.

According to yet a further aspect of the invention, the game card is a bingo card.

According to yet a further aspect of the invention, the coded magnetic stripe is provided on a face of the game card other than the face of the game card having the game indicia.

According to yet a further aspect of the invention, each game card includes an authorization code associated with the card at the time of the purchase.

The present invention is also directed to a system for tracking of game cards and activation of game cards. The system comprises game cards for playing a game of chance which game cards are sold to the public through distributors. Each game card requires activation to be eligible for a particular game and the agents have access to a device for scanning of codes provided on the game cards. The game cards have a series of game indicia on a face thereof and a scannable identifier code positioned relative to an edge of the game card for scanning by the scanning device. Each scannable identifier code uniquely identifies the particular game card associated therewith. The system includes a step of activating each game card sold, which is accomplished by scanning the identifier code and communicating the identifier code to an activation computer having a record of all game cards and which records the activation of the game cards such that only activated game cards are eligible to win the game of chance.

With this arrangement, the distributors and agents, etc. can have a supply of game cards which can be used for any game or a particular game, but requires activation to be eligible to win. The game cards can be computer scanned at the time of sale to track sales of game cards, and thus provide an accurate record of the number of game cards sold. Preferably, this step is also linked to the automatic activation of the particular game card. Each game card is uniquely identified and scanned as part of the activation step.

In a preferred embodiment of the system, the activation computer can return an authorization code which can be associated with the game card or with a receipt.

According to a preferred aspect of the invention, the activation computer has an electronic record of all game cards and the identifier codes thereof whereby a game card which appears to be a winning card can be checked to determine if it was properly activated as recorded by the activation computer and is authenticated based on comparison of the identifier code recorded and the identifier code of the game card.

In a preferred embodiment, the system also allows game cards to be reused for future games or be activated for a number of games at a single point in time. In this way, if a player happens to feel the game card is lucky, he can keep the game card and the distributor merely has to scan the game card and appropriately advise the authorization computer of the particular time frame in which the card is to be activated, and hence, eligible.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
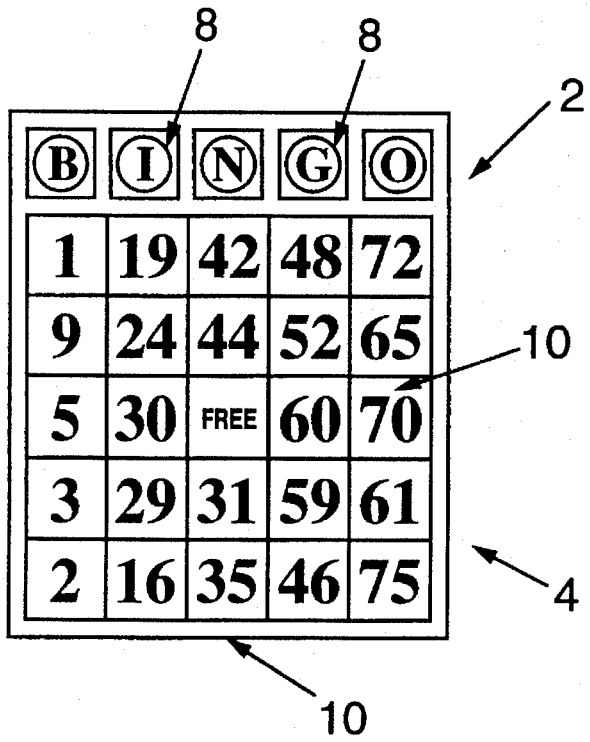
FIG. 1 is a front view of the game card.
Figure 2:
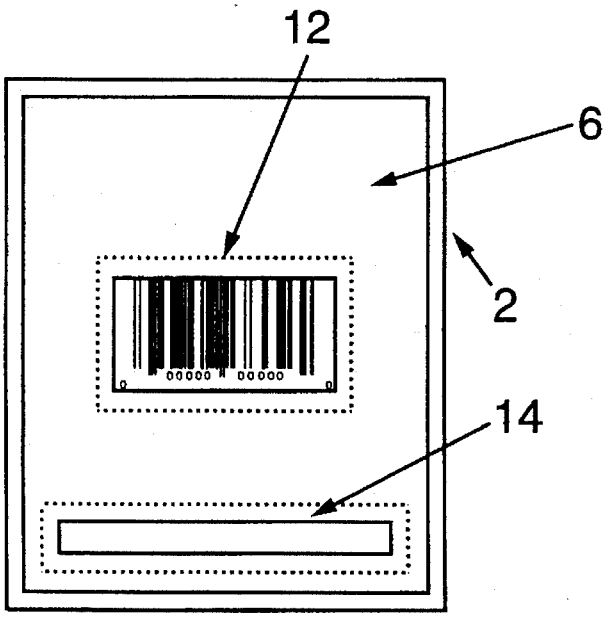
FIG. 2 is a back view of the game card.

The game card 2 shown in FIGS. 1 and 2 has a front face 4 and a back face 6. The front face 4 has alphabetic indicia, generally shown as 8, and numeric indicia, generally shown as 10. Indicia 8 and 10 form game indicia. The actual game card shown is a bingo card, which is merely a preferred application of the game card of the present invention. This game card would be activated for a particular game, such as a weekly bingo, a weekly draw or a special event, and it need not be in the form of a bingo card. The back face 6 includes a bar code 12 and a magnetic stripe 14. The magnetic stripe 14 has encoded information thereon which identifies the product as a bingo card and also includes a unique identifier code or serial code for the particular game card. At the time of manufacture, the magnetic stripe is encoded with this information, and thus, provides a simple means for uniquely identifying each game card.

Figure 3:
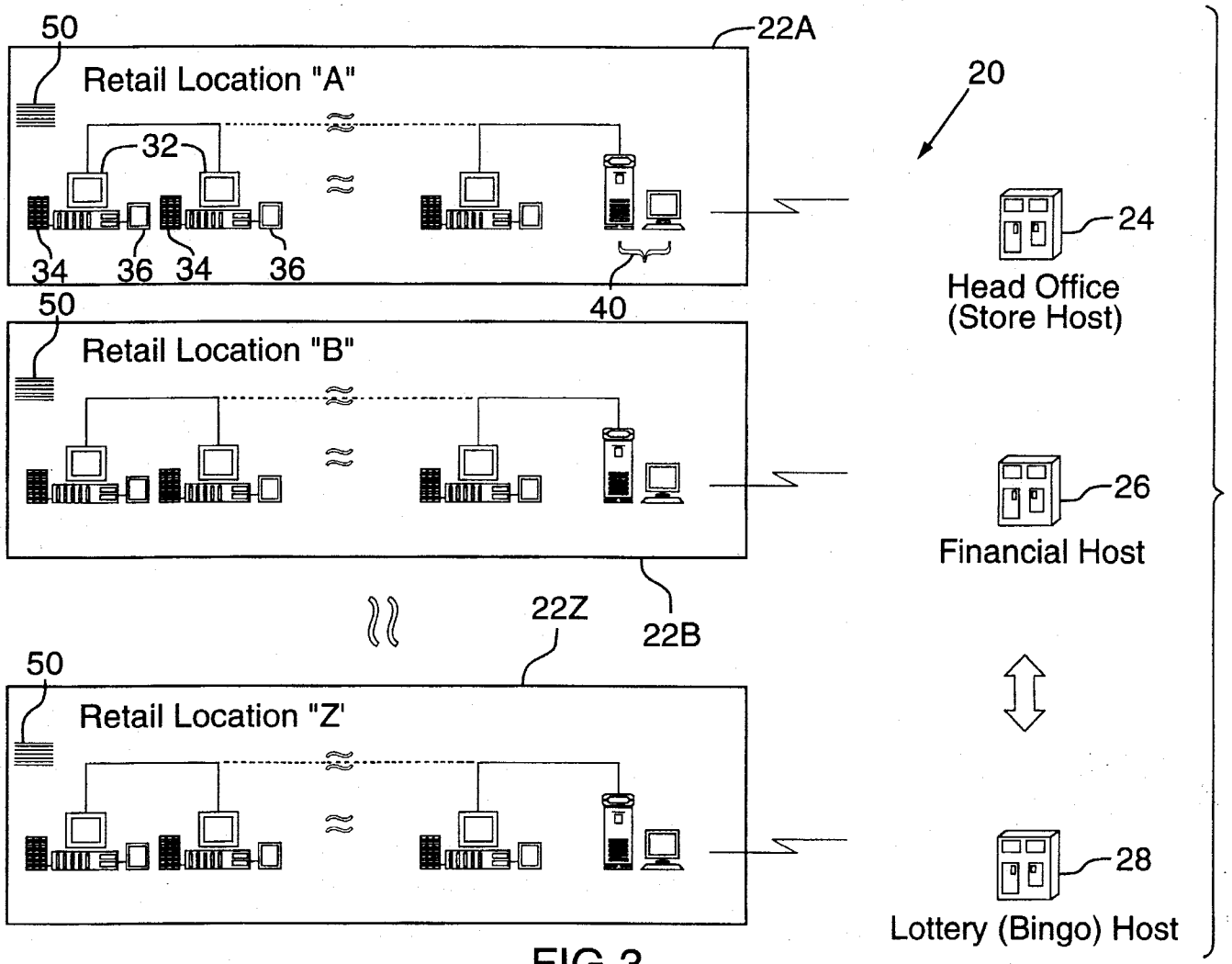
FIG. 3 is a schematic of a fully integrated Electronic Funds Transfer system for activating of game cards.

To understand the invention, the overall system 20 is shown in FIG. 3. In this case, a retail location 22, generally shown as 22*a*, 22*b* through 22*z*, are examples of locations which would sell game cards. Each of these locations illustrates the more complicated multi-lanes of Electronic Cash Register systems, such as those used in grocery or department stores. The purchaser would purchase the game card at the Electronic Cash Register just as he would with respect to any other product. The game card would be processed using one of the Electronic Cash Registers, generally shown as 32. Associated with this Electronic Cash Register is a point of sale scanner 34 for scanning of bar codes. In addition, the Electronic Cash Register cooperates with an Electronic Funds Transfer Device, generally shown as 36. The Electronic Funds Transfer Device allows payment directly from your bank account or as an advance applied against a credit card, etc.

These Electronic Funds Transfer Devices read magnetic stripes, such as magnetic stripe 14 provided on the back of the game card 2 and communicate the information together with transaction information to the appropriate computer by a real time connection. The clerk processes the game card by scanning of the game card (i.e. scanning of the bar code), and this step identifies the product as a game card.

Software of the Electronic Cash Register, upon identifying the game card by scanning the bar code, requests that the clerk swipe the game card through the Electronic Funds Transfer Device 36. This would cause the magnetic stripe to be read and the information of the game card (i.e. the fact that it is a game card, what type of game card and its unique serial number) can be communicated through the in-store processor 40 to the head office 24 of the retail location for tracking of the sale of game cards as well as communicating to a financial host 26 which is responsible for tracking of the game cards and the financial accounting between the retail location and the lottery host 28. Therefore, at the time of sale, the information is communicated to the lottery host 28 which then activates the particular game card for the desired game or games. Each retail location can be provided with a supply of game cards, generally shown as 50, which are essentially of no value unless they are activated. Activation can only occur when the game cards are sold and appropriately swiped through the Electronic Funds Transfer Device or other device that communicates the information to a computer (i.e. the lottery host which effectively activates the game card). In this way, the purchaser receives an activated game card which can be distinguished readily by a computer from the supply of unactivated game cards 50. As far as the process for tracking of game cards, the fact that the game cards have been separately scanned by the bar code scanner, the head office has a separate source of information to determine how many game cards have been sold as they track the game cards in the same way in which they track other products that they now sell having a bar code thereon. Additionally, the retail location can receive information from the activation computer regarding the number of game cards sold to cross check versus the information derived from the bar code scanning. The financial distribution of funds is more easily accomplished, as the financial host is tracking game cards during the authorization step, and thus, has an accurate account of the number of game cards which have been activated by the retailer. If desired, the supply of game cards 50 can be maintained at the retail location and used for the next game, and thus, there is no need to return unused game cards. In the event that the game cards are replaced for the next game, any remaining supply 50 can be disposed of and need not be returned, as they will be of no value. If someone steals an unactivated game card, it is of no value other than the fact that it is a printed game card. It has not been activated and is not eligible to win.

In semi-integrated systems, the amount of the sale is electronically communicated to the Electronic Funds Transfer Device, which either responds with an accept or decline signal.

Figure 4:
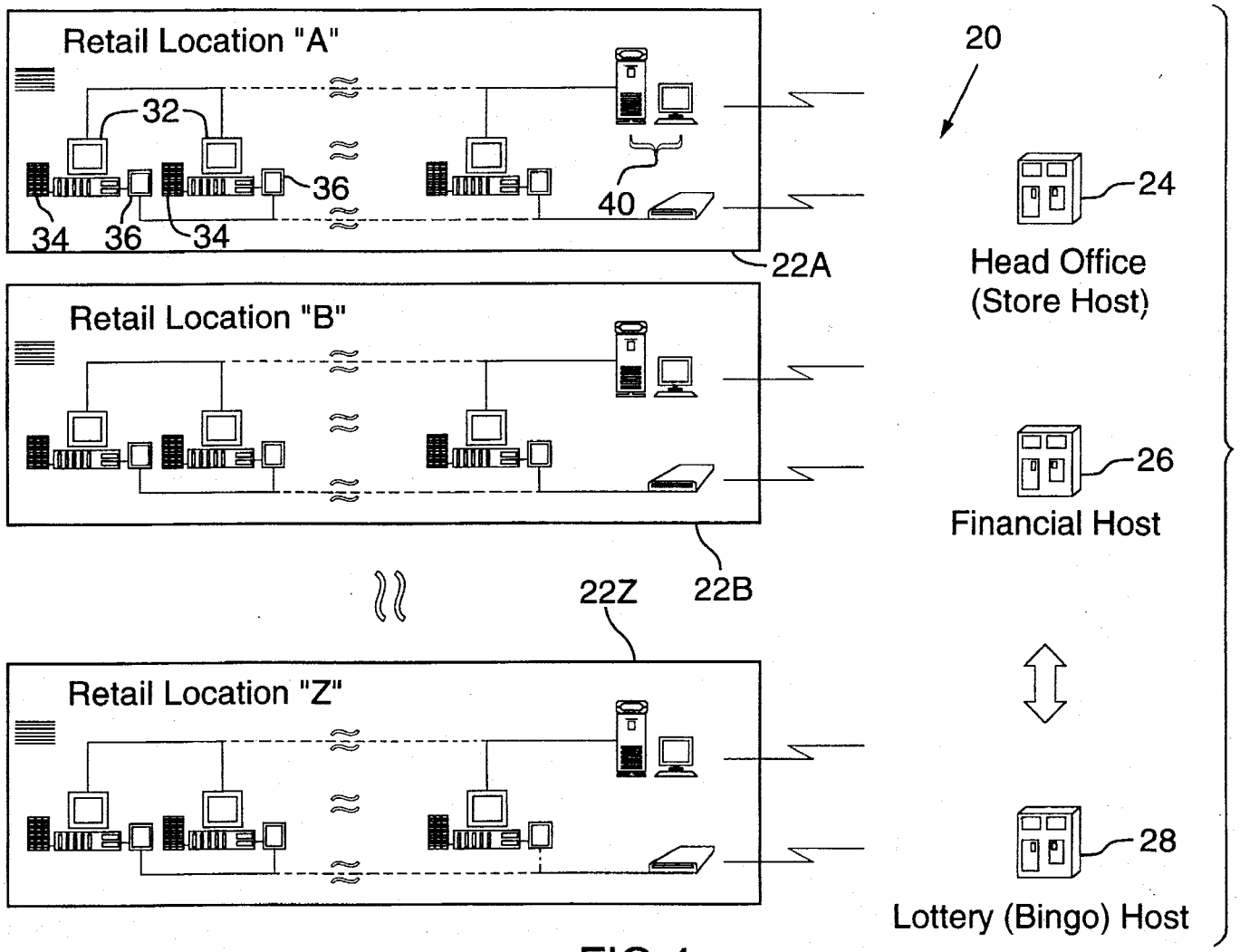
FIG. 4 is a schematic of a semi-integrated Electronic Funds Transfer system for activating game cards.

FIG. 4 shows a semi-integrated point of sale system. In this case, each Electronic Cash Register 32 and bar code scanner 34 is connected to the In Store Processor 40. Electronic Fund Transfer Device 36 has its own communication connection 37 for connection with the Financial Host computer 26. Tracking sales of game cards by bar code information is communicated to the Head Office Store Host computer 24. Separately, information from magnetic stripes is sent to the Financial Host computer 26. The Financial Host computer then communicates with the Lottery Host computer.

The fully Integrated System of FIG. 3 passes all information through the Head Office computer. The information derived from the magnetic stripe is received by the Store Host computer and forwarded to the Financial Host computer for accounting purposes and on to the Lottery Host computer 28. Software associated with the Electronic Funds Transfer Device recognizes a swiped game card.

Figure 5:
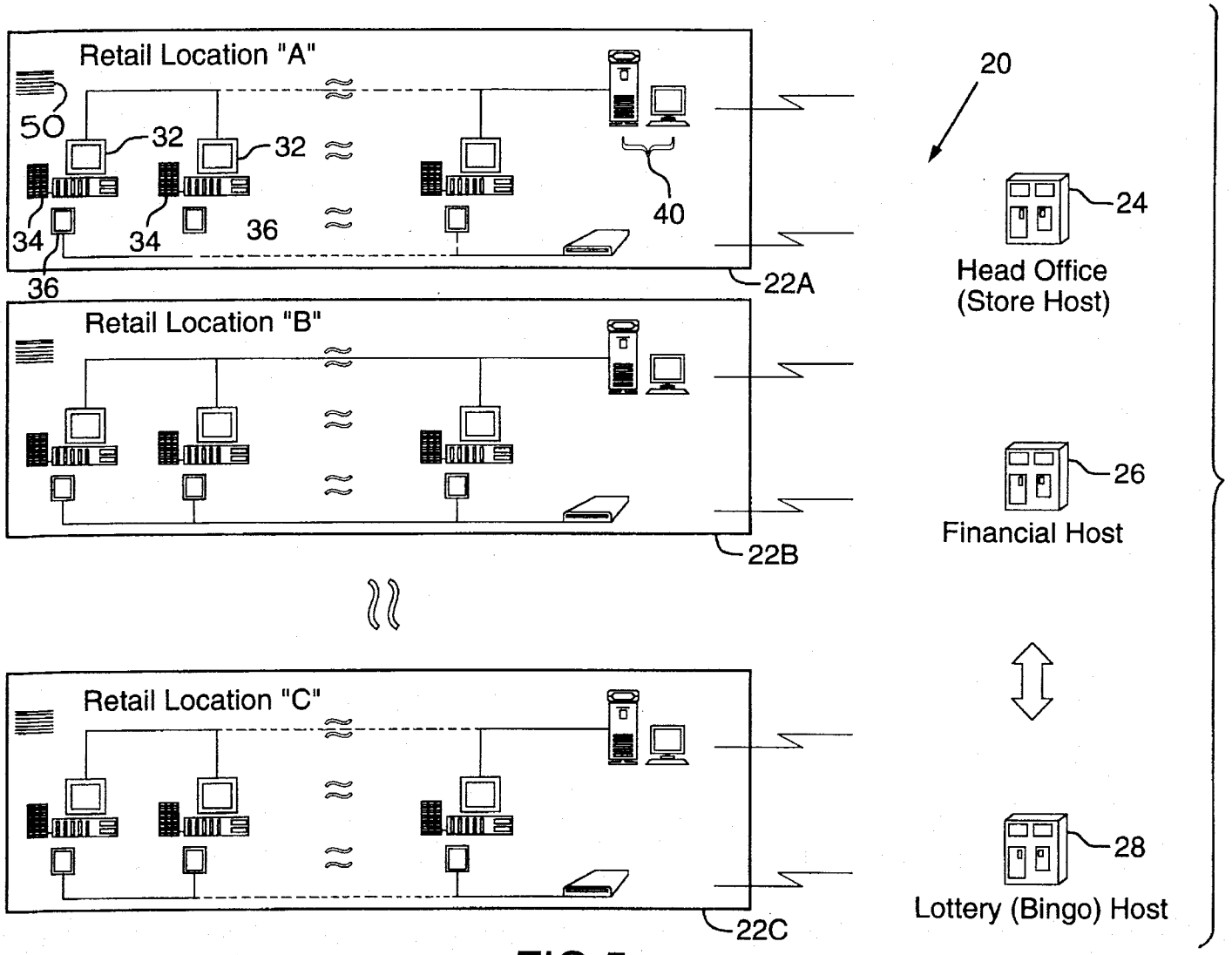
FIG. 5 is a schematic of a stand-alone Electronic Funds Transfer system.

FIG. 5 illustrates a stand-beside or stand-alone system where there is no automated link between the Electronic Fund Transfer devices 36 and the Electronic Cash Registers 32. With this system, the clerk manually enters the amount to be paid in the Electronic Fund Transfer Device and the card holder enters his PIN. When the acknowledgement that the transaction has been accepted is received the clerk then manually presses a key on the Electronic Cash Register indicating the transaction has been paid by Electronic Funds Transfer. Systems of this type do not require integration of the Electronic Cash Register and the Electronic Fund Transfer Device. With this system, the game card is swiped on the Electronic Funds Transfer Device, which indicates this step to the Financial Host computer. The Financial Host computer recognizes this step as a request for activation of the game card. This step is then communicated to the Lottery Host Computer.

An enhancement of the systems allows the purchaser to additionally swipe a banking card or other identifying card which uniquely identifies him after the game card is swiped. This information can also be stored by the lottery bingo host, and thus, associates the particular activated bingo card or game card with a particular individual identified by his banking card serial number. For example, in the event that the game card is a winning game card, the lottery bingo host can track whether the winnings have been claimed, and if not, can provide notice to the particular financial institute of the fact that a certain person identified by serial number is a winner, and thus, can provide feedback to that potential winner. This allows automatic tracking. If desired, winnings could be deposited to the bank account identified by the banking card. Typically, the PIN number of the user would only be entered if payment is to be made by Electronic Fund Transfer.

A further enhancement of the system provides users with their own user identification card for games. This would allow the host computer to record pertinent information of the user and allow the lottery bingo host computer to provide notice directly to them of winnings of any game cards which were winning game cards, yet the particular prize was not picked up. In this way, people could play these particular games without manually determining whether they have a winning game card or ticket. If the particular winning game card has been associated with the user I.D. at the time of purchase, this would provide a valuable selling feature for the particular game and would not require an undue amount of follow-up, as most of the game cards are, in fact, losing game cards and there are very few winning game cards and yet fewer again, winning game cards where the prize is not picked up. Such a card could include preauthorization regarding depositing winnings to a designated bank account, if desired.

The above arrangement can also be used to acquire demographic information of the players which can be helpful for future marketing of this or related products.

A further enhancement of the system involves using Smart Cards to purchase game cards and recording on the Smart Card information identifying the purchased game card. This information can be scanned at a later date to determine whether any winning game cards or tickets, etc. have been purchased.

The above system is much easier to carry out, more accurate and will reduce the number of disputes with respect to the sale of game cards.

From the above, it is apparent that the Electronic Funds Transfer Device can now be used to track the sale of certain products and to also form part of a communication path to change the status of the product while still functioning when required or as part of the same transaction to function its primary role of transferring funds electronically.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A system for game card tracking and activation comprising:

game cards for playing a game of chance which game cards are provided to agents for resale to the public and require activation to be eligible to win and where the agents have access to a device for interpreting a coded magnetic stripe, an Electronic Cash Register having an associated bar code scanner, and a communicating device for communicating information derived from interpreting of magnetic stripes, said game cards having fixed game indicia on a face thereof necessary for playing the game of chance and a coded magnetic stripe positioned relative to an edge of the game card for interpreting by said interpreting device, each scannable identifier code uniquely identifying the particular game card associated therewith, and wherein said system activates each game card sold by scanning said identifier code and communicating said unique identifier code by means of said communicating device to an activation computer which records the activation of each game card such that only activated game cards can win said game of chance as recorded by said activation computer, and wherein each game card includes a common bar code generically identifying said game cards which is scanned when the game card is sold by said bar code scanner to track the number of game cards sold.

2. A system as claimed in claim 1 wherein said interpreting device is part of an Electronic Funds Transfer device allowing a user to pay for purchases using a banking card, said Electronic Funds Transfer device including additional software for distinguishing between interpreting of the magnetic stripe on a game card to be activated and interpreting of a magnetic stripe on a bank card necessary as part of the procedure to transfer funds using said Electronic Funds Transfer device, and wherein said communicating device forms part of said Electronic Funds Transfer device such that said communicating device and said interpreting device are used for activating game cards and as part of the Electronic Funds Transfer procedure.

3. A system for game card tracking and activation comprising:

game cards for playing a game of chance which game cards are provided to agents for resale to the public and require activation to be eligible to win, Electronic Cash Registers each having an associated bar code scanner for scanning bar codes and a magnetic stripe scanner for scanning of coded magnetic stripes and communicating scanned codes to an activation computer, said game cards having a series of fixed game indicia on a face thereof necessary for playing said game of chance and a coded magnetic stripe positioned relative to an edge of the game card for scanning by said magnetic stripe scanner, each coded magnetic stripe having an identifier code uniquely identifying the particular game card associated therewith, and each game card has a common bar code thereon generically identifying said game card; said system activating each game card sold by scanning said bar codes using said bar code scanners to track sale of game cards by bar code and scanning said coded magnetic stripe and communicating said identifier code to said activation computer which records the activation of each game card such that only activated game cards can win said game of chance as recorded by said activation computer.

4. A system as claimed in claim 3 wherein said activation computer has a record of all game cards and the identifier codes thereof whereby a game card which appears to be a winning game card can be authenticated to determine if it was properly activated as recorded by said activation computer.

5. A system as claimed in claim 4 wherein said winning game card is authenticated based on comparison of the identifier code recorded and the identifier code of the game card.

6. A system as claimed in claim 4 wherein said activation computer also has record of the indicia on the game card and a winning game card is additionally authenticated by confirming certain indicia on said game card.

7. A system as claimed in claim 3 including a further computer which is in communication with said Electronic Cash Registers when a game card is activated, said further computer tracks the sale of game cards and allocates compensation in accordance with sales of game cards to at least two bank accounts in a predetermined manner.

8. A system as claimed in claim 7 wherein said identifier code includes a portion which uniquely identifies the type of game card followed by unique code of the particular game card.

9. A method of authorizing game cards which have a machine readable code comprising:

producing game cards having fixed game indicia on a face thereof and a coded magnetic stripe having a coded portion uniquely identifying the type of game card and a coded portion providing a unique identity code for the particular game card, recording the unique identity code of each game card in a computer arrangement, and activating each game card for a certain period or event when purchased, each game card being activated by scanning said coded magnetic stripe and communicating at least said unique identity code to said computer arrangement which records the same, and wherein each game card includes a common bar code generically identifying said game cards and wherein each came card has the bar code thereof read and recorded when the game card is purchased to thereby track sales of game cards.

10. A method of authorizing game cards as claimed in claim 9 wherein said method also includes automatic electronic distribution to at least two different bank accounts of predetermined portions of the funds received from the purchase of the game card when a game card is activated.

11. A system for game card tracking and activation comprising:

game cards for playing a game of chance which game cards are provided to agents for resale to the public and require activation to be eligible to win and where the agents have access to a device for interpreting a coded magnetic stripe, a communicating device for communicating information derived from interpreting of magnetic stripes and a product tracking system which scans bar codes of products and records the sales thereof, said game cards having fixed game indicia on a face thereof necessary for playing the game of chance, a coded magnetic stripe positioned relative to an edge of the game card for interpreting by said interpreting device, each scannable identifier code uniquely identifying the particular game card associated therewith, said game cards each including a common bar code generically identifying the game cards for tracking sales thereof, and wherein said system activates each game card sold by scanning said bar code and requiring scanning of said identifier code and communicating said unique identifier code by means of said communicating device to an activation computer which records the activation of each game card such that only activated game cards can win said game of chance as recorded by said activation computer and wherein sales of game cards are tracked by said product tracking system and said activation computer.

12. A system as claimed in claim 11 wherein said scanning device for scanning of said magnetic stripe is part of an Electronic Funds Transfer device and said product tracking system includes electronic cash registers and associated bar code scanners.

13. A system as claimed in claim 12 wherein each electronic cash register is programmed upon recognition of a scanned game card bar code to produce a signal displayed on said cash register to proceed with activation of the scanned game card.

* * * * *